US010161150B1

(12) United States Patent
Kirk

(10) Patent No.: US 10,161,150 B1
(45) Date of Patent: Dec. 25, 2018

(54) SWIMMING POOL HOSE RETENTION DEVICE

(71) Applicant: Joshua Kirk, Tucson, AZ (US)

(72) Inventor: Joshua Kirk, Tucson, AZ (US)

(73) Assignee: Joshua Kirk, Tucson, AZ (US)

( * ) Notice: Subject to any disclaimer, the term of this patent is extended or adjusted under 35 U.S.C. 154(b) by 0 days.

(21) Appl. No.: 15/588,623

(22) Filed: May 6, 2017

(51) Int. Cl.
*E04H 4/16* (2006.01)
*E04H 4/12* (2006.01)

(52) U.S. Cl.
CPC ..... *E04H 4/1209* (2013.01); *E04H 4/16* (2013.01)

(58) Field of Classification Search
CPC ..... B65H 75/403
USPC ..... 4/490; 482/55
See application file for complete search history.

(56) References Cited

U.S. PATENT DOCUMENTS 2,466,912 A * 4/1949 Rice ..... F16L 3/1233 24/129 R
2,636,704 A * 4/1953 Norberg ..... D06F 39/12 24/131 R
3,676,884 A * 7/1972 Wulc ..... E04H 4/1645 15/1.7
4,228,553 A * 10/1980 Genuit ..... B65H 75/403 134/167 R
4,417,710 A * 11/1983 Adair ..... A61C 19/00 248/205.2
5,068,928 A * 12/1991 Powell ..... E04H 4/10 24/457
5,110,075 A * 5/1992 Reid ..... E04H 4/14 134/167 R
5,413,297 A * 5/1995 Adams ..... A47G 25/0614 248/215
D377,308 S * 1/1997 McNamara ..... E04H 4/10 D8/370
5,593,122 A * 1/1997 Robertson ..... E04H 4/10 248/205.1
D552,980 S * 10/2007 Svedberg ..... E04H 4/10 D8/395
8,448,268 B2 * 5/2013 Bradshaw ..... E04H 4/14 211/100
8,997,269 B1 * 4/2015 Jackson ..... E04H 4/169 4/490
D731,877 S * 6/2015 Hanson ..... E04H 4/169 D30/161
2010/0096513 A1 * 4/2010 Beebe ..... E04H 4/14 248/75

* cited by examiner

*Primary Examiner* — Lori Baker

(57) ABSTRACT

A removable retention device for a swimming pool vacuum or pressure hose. The retention device holds the hose along a side wall of a swimming pool when there is a desire to keep the hose out of the way of a swimming pool user. The retention device is dimensioned to be placed over an edge of the swimming pool, either on a pool deck or over a wall of the swimming pool, and the geometry of the retention device is such that it captures the hose against the side wall of the pool. When restraining the hose, the retention device is situated such that the restrained hose is located at or below a waterline of the swimming pool. The retention device can remain in place or be removed from the pool when the hose is in use, after freeing the hose from the retention device.

10 Claims, 4 Drawing Sheets

SWIMMING POOL HOSE RETENTION DEVICE

RELATED APPLICATIONS

There are currently no applications co-pending with the present application.

FIELD OF THE INVENTION

The presently disclosed subject matter is directed toward swimming pool attachments. More specifically, the present invention relates to devices for retaining swimming pool cleaner vacuum or pressure hoses against a side wall of a pool.

BACKGROUND—PRIOR ART

The following is a tabulation of some prior art that presently appears relevant:

| U.S. patents | | | |
|---|---|---|---|
| Pat. No. | Kind Code | Issue Date | Patentee |
| 8,997,269 | B1 | Apr. 7, 2015 | Jackson |
| 5,110,075 | | May 5, 1992 | Reid |
| **U.S. patent application Publications** | | | |
| Publication Nr. | Kind Code | Publ. Date | Applicant |
| 20100096513 | A1 | Apr. 22, 2010 | Beebe |

Swimming pool cleaning devices are commonly used to aid in the task of maintaining a clean pool. A hose is often used to connect the cleaning devices to a vacuum or pressure system of the pool via a port located on a pool wall. Generally the hose is long enough to reach all parts of the pool. When using the pool, the hose is either removed from the pool or it remains in the pool.

Removing the hose from the pool presents a challenge as the water within the hose has to be drained, the hose has to be pulled from the pool, and the hose has to be coiled or otherwise stored outside of the pool. After using the pool, the hose must be returned to the pool, and refilled with water to prime the hose. Removing and returning the hose to the pool is time consuming, difficult and can lead to the introduction of dirt into the pool.

Pool users often leave the hose in the pool which causes other difficulties such as avoiding the hose while using the pool. The pool hose can interfere with swimming activities as a swimmer must avoid the hose by swimming around, over or under the hose, or continuously move the hose out of the way. Swimming with the hose in the pool can be dangerous as the hose can restrict the swimmer's motion and impact against the hose can lead to injury.

To prevent the pool hose from interfering with normal pool activities, the pool hose should be kept against the wall of the pool. A removable device or series of such devices that keep the pool hose against the side of the pool, without presenting a danger to swimmers or other pool users, is required.

Several methods of restraining a pool hose have been proposed—for example, in U.S. Pat. No. 8,997,269 to Jackson (2015) and U.S. Pat. No. 5,110,075 to Reid et al. (1992). These proposed hose retention devices, while likely adequate for restraining a pool hose against the wall of a pool, contain rigid components such as hooks and plates. These rigid components have the potential to cause injury to pool users while employed in the manner required to restrain the pool hose during use of the pool. In addition, both of these pool hose retention methods require permanent installation to the side of a pool via fasteners and possibly removal of material from the pool wall. These pool hose restraint methods would be considered permanent and there is potential for damage if removal is attempted.

In U.S. Patent Application 20100096513 by Beebe (2010) an alternate method of restraining a pool hose is proposed. This proposed methodology for restraining the pool hose is via the use of a clip and suction cup to attach the hose to the side wall of the pool. This method uses a metallic hook which again has the potential to cause injury to pool users. The suction cup, while potentially adequate for pools with smooth walls, will not work well on pools with rough or uneven surfaces. The suction cup will degrade with time and reduced restraint force will occur.

SUMMARY

A swimming pool hose retention device used to retain a pool hose, such as the type used to connect a pool cleaning device to a swimming pool vacuum or pressure system. The swimming pool hose retention device is designed to be placed over the edge of a pool, either on a pool deck or a wall of the pool. A protrusion feature of the device extends below the surface of the water in the swimming pool and is dimensioned to restrain the swimming pool hose.

Advantages

Several advantages of one or more aspects are as follows:

- a removable pool hose retention device,
- no modifications to the pool, a pool wall, or a deck of the pool are required,
- no fasteners or adhesives are required to install the device to the pool or pool deck,
- the retention force does not change over time,
- the surface roughness of the pool side walls does not affect retention force,
- the retention device is not rigidly attached and if impacted is less prone to cause injury, and
- surfaces and edges of the retention device may be rounded to minimize risk of injury upon contact with the device.

Other advantages of one or more aspects will be apparent from a consideration of the drawings and ensuing description.

DRAWINGS—FIGURES

The advantages and features of one embodiment of the pool hose retention device will become better understood with reference to the following more detailed description and claims taken in conjunction with the accompanying drawings in which like elements are identified with like symbols and in which:

DRAWINGS—REFERENCE NUMERALS

Figure 1:
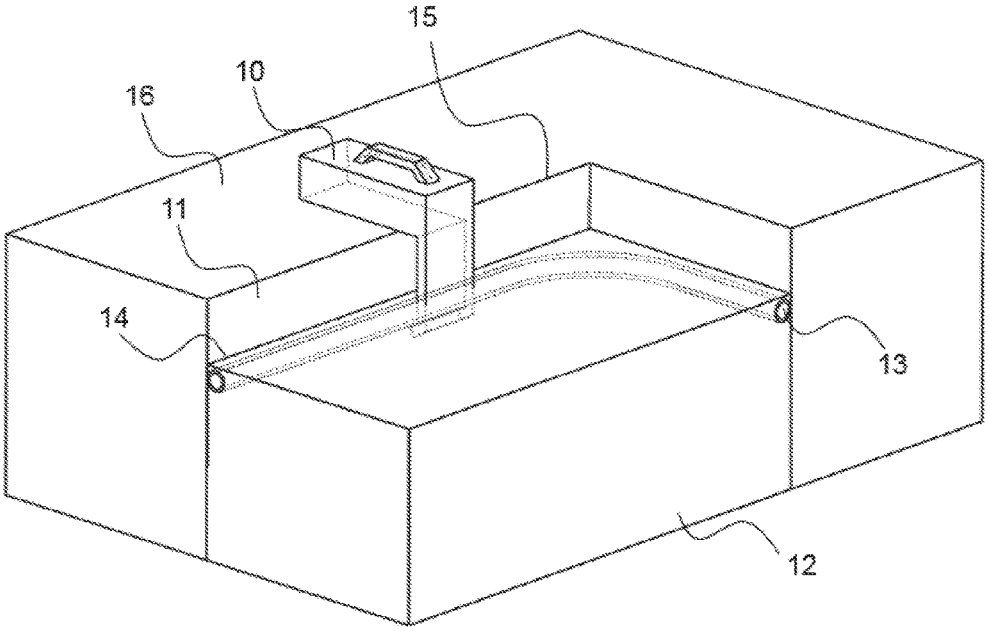
FIG. 1 is an environmental view of one embodiment of the swimming pool hose retention device, in service retaining a pool hose against the side wall of a swimming pool.

10 Swimming Pool Hose Retention Device
11 Side Wall
12 Pool Water
13 Pool Hose
14 Waterline
15 Pool Edge
16 Pool Deck
30 Handle
31 Protrusion

DETAILED DESCRIPTION

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention. Only one particular configuration shall be shown and described for the purposes of clarity and disclosure and not by way of limitation of scope. The terms "a" and "an" herein do not denote a limitation of quantity, but rather denote the presence of at least one of the referenced items.

The principles of one embodiment of the present invention are illustrated with reference to FIGS. 1 and 2. Those principles relate to an illustrated swimming pool hose retention device 10 that fits over a swimming pool edge 15 and restrains a swimming pool hose 13 against a side wall 11 of a swimming pool. The swimming pool hose retention device 10 allows users of the swimming pool to avoid the process of removing the pool hose 13 from the pool, or avoid the risk of having the pool hose 13 interfere with pool activities. The swimming pool might be an above-ground, an in-ground, a temporary, and/or a seasonal swimming pool. However, the swimming pool is of the type that uses a pool cleaning device with a vacuum or pressure pool hose 13.

FIG. 1 illustrates an environment in which a swimming pool hose retention device 10 is used. It is expected that multiple swimming pool hose retention devices (not shown) will be used to retain the swimming pool hose 13 along the length of the pool hose 13. The swimming pool hose retention device 10 shown in FIGS. 1 and 2 uses gravity and friction forces against a pool deck 16 or the side wall 11 to restrain the swimming pool hose retention device 10. The swimming pool hose retention device 10 restrains the swimming pool hose 13 against the side wall 11 of the swimming pool, such that the pool hose 13 is located at or below the waterline 14 of the pool water 12. The swimming pool hose retention device 10 will have adequate mass to ensure that the swimming pool hose retention device 10 does not move significantly during normal pool user activity However, the use of fasteners or adhesive is not precluded when installing or using the swimming pool hose retention device 10.

Figure 2:
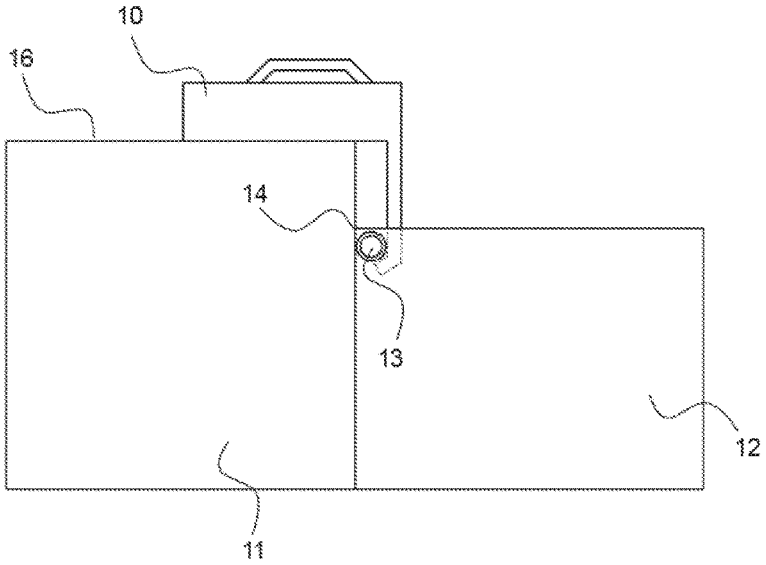
FIG. 2 is environmental, side view of one embodiment of the swimming pool hose retention device, in service retaining a pool hose against the side wall of a swimming pool.
Figure 3:
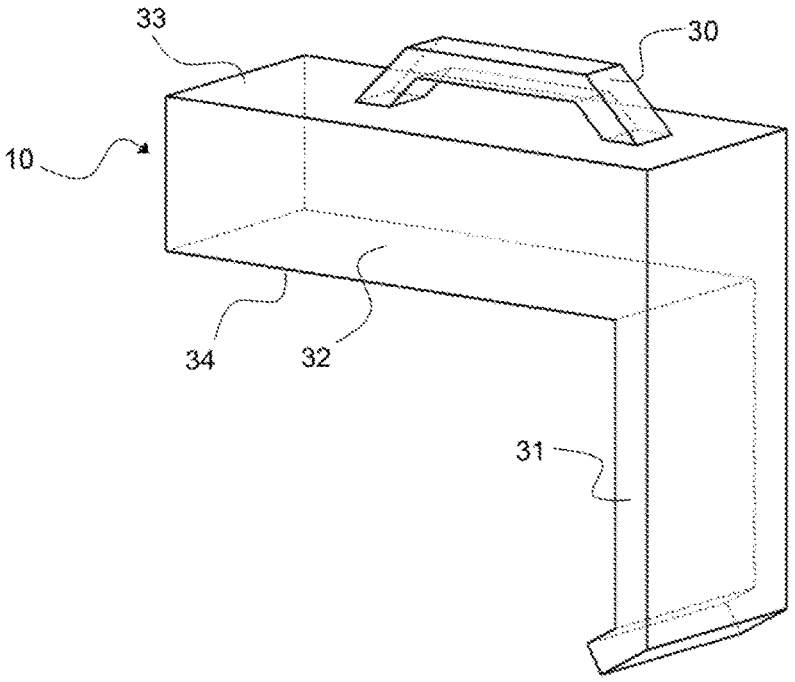
FIG. 3 is a perspective view of one embodiment of the swimming pool hose retention device.
Figure 4:
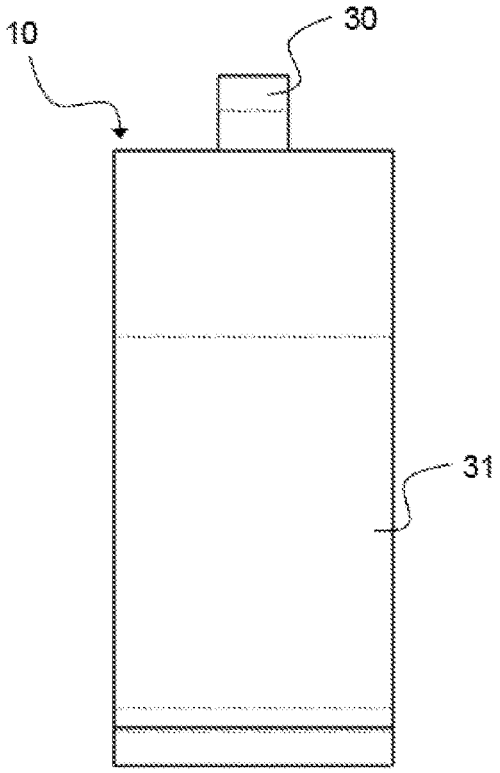
FIG. 4 is a front view of one embodiment of the swimming pool hose retention device.
Figure 5:
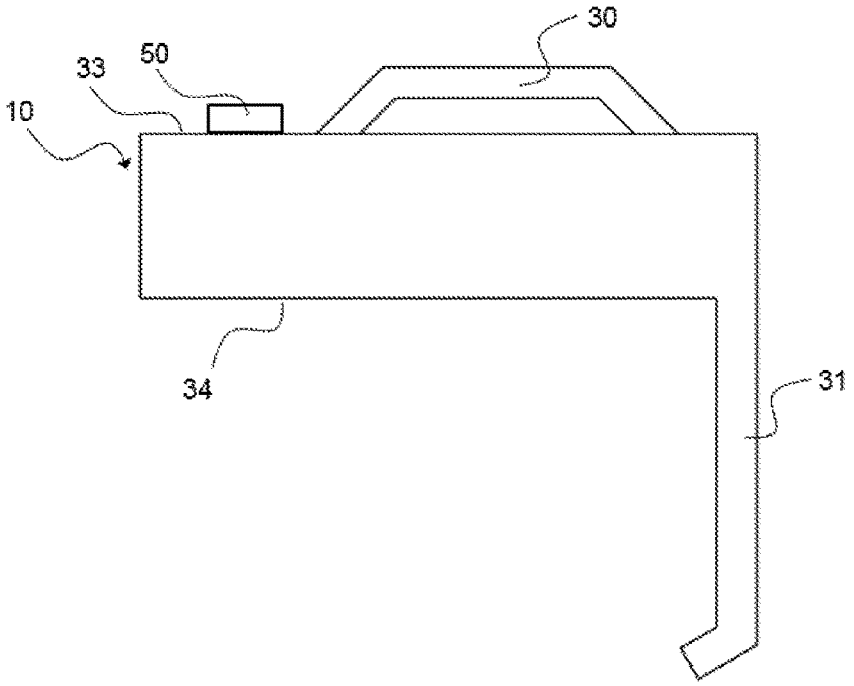
FIG. 5 is a side view of one embodiment of the swimming pool hose retention device.

The illustrated embodiment of the swimming pool hose retention device 10 includes a protrusion 31, shown in FIGS. 4-5, which extends below the surface of the pool water 12 where it restrains the swimming pool hose 13 against the side wall 11 of the swimming pool, as shown in FIG. 1-2. An optional handle 30, as shown in FIGS. 3-5, can be included to aid in handling of the swimming pool hose retention device 10. The swimming pool hose retention device 10 includes a volume 32 with a top surface 33 and a bottom surface 34, as shown in FIGS. 3 and 5. The bottom surface 34 is dimensioned to directly contact the pool deck 16 or side wall 11 of the swimming pool, adjacent to the pool edge 15.

For swimming pools with pool decks 16 that are of insufficient width (not shown) to allow for the illustrated embodiment of the swimming pool hose retention device 10 to fit on the pool deck 16, the swimming pool hose retention device 10 embodiment can be revised to fit over the pool wall. In this embodiment (not shown), the swimming pool hose retention device 10 fits over the wall of the swimming pool and is held in place by gravity, friction and/or clamping force to the pool wall. However, the use of fasteners or adhesive is not precluded when installing or using this embodiment of the swimming pool hose retention device 10.

The swimming pool hose retention device 10 can be assembled from a plurality of pieces assembled such that portions, for example the volume 32 and protrusion 31, can be removed or reoriented relative to the remainder of the device 10. The plurality of pieces can be assembled through the use of fasteners 70 or with a feature or features that allow/s assembly without the use of fasteners 80.

Figure 6:
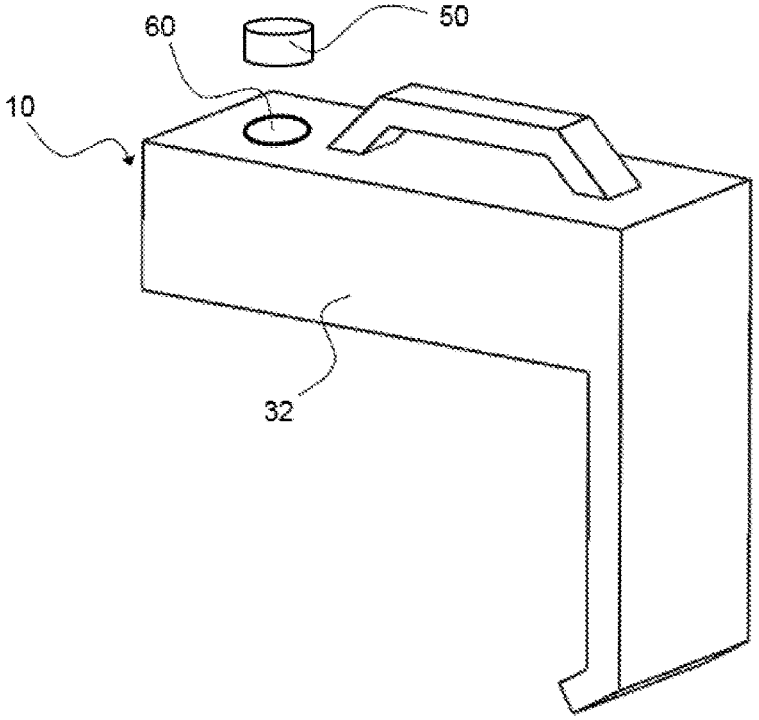
Figure 7:
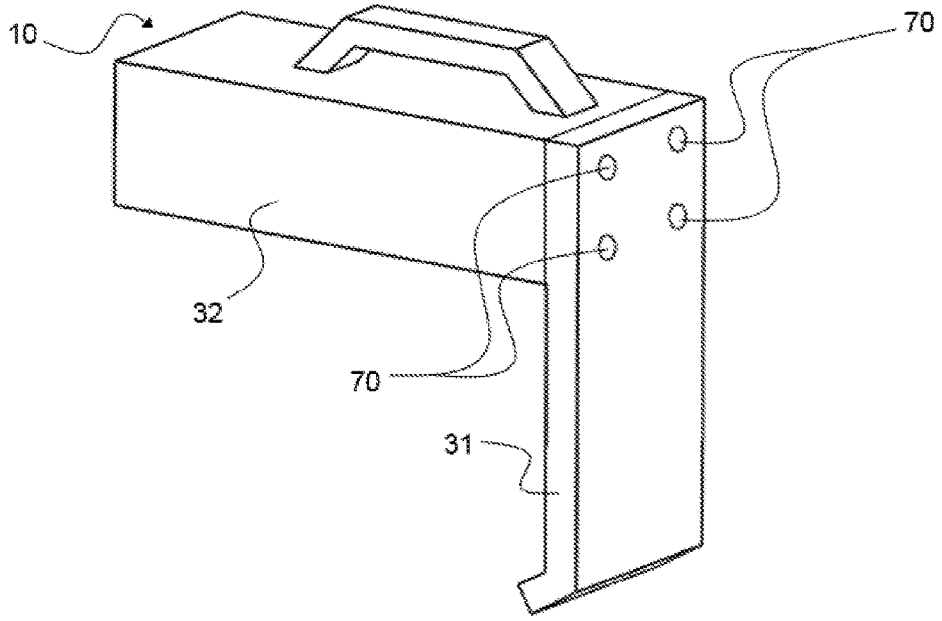
Figure 8:
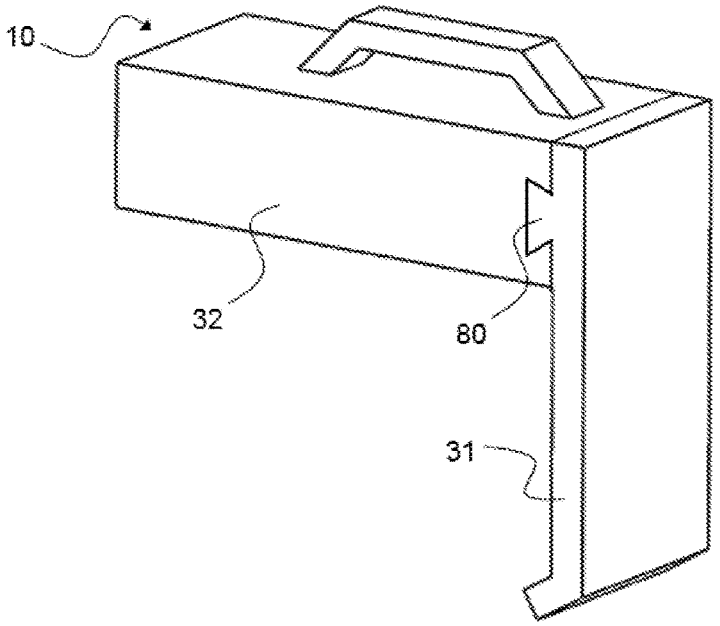

The swimming pool hose retention device 10 can be manufactured using common materials and processes. One possible material that can be used is a plastic that is resistant to ultraviolet light and chemicals, and is of adequate strength to maintain form when exposed to the loads observed in a swimming pool environment. Common plastic material processing techniques such as rotational molding or blow molding could be used to manufacture a hollow shell or shells of the swimming pool hose retention device 10. If this method of manufacture is used, the mass would be increased using a fluid or solid material to fill the device. A fill hole 60, as shown in FIG. 6, would be provided to allow the user to fill the device with the fluid or solid material. Sand and/or water are examples of materials that could be used to increase the mass. A plug or cap 50, as shown in FIGS. 5-6, would be used to seal the swimming pool hose retention device 10, preventing leakage of the material used to fill the device. The relatively simple design of the swimming pool hose retention device 10, and the material of construction, makes the swimming pool hose retention device 10 a cost-effective design due to the low material and labor costs involved.

The swimming pool hose retention device 10 can be easily utilized by the typical pool user with simple instructions and little or no required training. In addition, the pool user can perform the installation of the swimming pool hose retention device 10 without the use of tools or pool alterations. After initial purchase or acquisition of a swimming pool hose retention device 10 this device would be installed as indicated in FIG. 1 or 2. Prior to installing the swimming pool hose retention device 10 it would, if necessary, be filled with a fluid or solid material to increase the mass, ensuring that the device does not move significantly during pool usage. The swimming pool hose retention device 10 can be easily removed from the pool and stored in a different location when not in use. The swimming pool hose retention device 10 can be left in place while the pool cleaning device is active, after freeing the pool hose 13.

The design of the swimming pool hose retention device 10 can be modified to ensure optimal performance for different pool designs or to add design elements that increase the visual appeal of the device. The swimming pool hose retention device 10 can also be formed into a representation of other physical objects (e.g. elephant, cat, etc.). The swimming pool hose retention device 10 surfaces and edges may be rounded to minimize risk of injury upon contact with the device.

Advantages

From the description above, a number of advantages of swimming pool hose retention device embodiments become evident:

a) A pool hose retention device that is removable from a pool and can be stored when not required or during seasons when the pool is not used.
b) No modifications to the pool, pool wall or pool deck are required.
c) No fasteners or adhesives are required to attach the device to the pool or pool deck; however, fasteners or adhesives can be used if desired to further restrain the pool hose retention device.
d) The retention force does not change over time.
e) The surface roughness of the pool side walls does not affect retention force.
f) The retention device is not rigidly attached and is less prone to cause injury if impacted.
g) The surfaces and edges of the retention device may be rounded to minimize risk of injury upon contact with the device.
h) The embodiment of the retention device can be optimized for different pool designs or to add design elements to increase the visual appeal or functionality of the device.

CONCLUSION, RAMIFICATIONS, AND SCOPE

The embodiment of the swimming pool hose retention device described will allow users to quickly and easily install the device and restrain a swimming pool hose. After installation of the device, the swimming pool can be used without having to remove the pool hose from the pool or risk having the pool hose interfere with pool activities. Having the pool hose restrained makes the pool more convenient to use while improving safety. Safety is improved because the pool hose will be less likely to entangle pool users and reduces the chance of impacts with the pool hose.

The foregoing descriptions of specific embodiments of the present invention have been presented for the purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application. The description should thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the appended claims and their legal equivalents.

I claim:

1. A retention device for a swimming pool hose comprising: a volume with a bottom and a top surface, wherein said bottom surface is dimensioned to be placed adjacent to an edge of a pool, directly in contact with at least one of a pool deck or a side wall of said pool, and a protrusion feature of said device that extends below a surface of water in said pool and is dimensioned to restrain said swimming pool hose adjacent to said side wall of said cool and approximately parallel to said surface of water in said pool.

2. The retention device of claim 1 wherein said device is a one piece hollow shell.

3. The retention device of claim 1 wherein said device includes a handle feature to aid in handling of said device.

4. The retention device of claim 1 wherein said device is assembled from a plurality of pieces.

5. The retention device of claim 4 wherein one or more of said plurality of pieces is a hollow shell.

6. The retention device of claim 4 wherein said plurality of pieces are assembled with the use of fasteners.

7. The retention device of claim 4 wherein said plurality of pieces are assembled without the use of fasteners.

8. A swimming pool hose retention device comprising: a volume with a bottom and a top surface, and a protrusion feature attached to said volume, wherein said bottom surface is dimensioned to be placed adjacent to an edge of a swimming pool directly in contact with at least one of a pool deck or a side wall of said swimming pool, and wherein said protrusion extends below a waterline in said swimming pool, and said protrusion restrains a swimming pool hose against said side wall of said swimming pool and approximately parallel to said waterline.

9. The retention device of claim 1 wherein said device includes at least one fill hole to allow access to the interior of the device and at least one plug or cap to close said fill hole.

10. The retention device of claim 8 wherein said device includes at least one fill hole to allow access to the interior of said device and at least one plug or cap to close said fill hole.

* * * * *